US006328440B1

(12) United States Patent
Medin et al.

(10) Patent No.: US 6,328,440 B1
(45) Date of Patent: Dec. 11, 2001

(54) BUCKLING CONTROL FOR A HEATED BELT-TYPE MEDIA SUPPORT OF A PRINTER

(75) Inventors: Todd R. Medin; Steve O. Rasmussen, both of Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/479,817

(22) Filed: Jan. 7, 2000

(51) Int. Cl.[7] ..... B41J 2/01
(52) U.S. Cl. ..... 347/102; 347/104; 271/7
(58) Field of Search ..... 347/102, 104, 347/105; 271/4.05, 4.06, 7

(56) References Cited

U.S. PATENT DOCUMENTS

| | | | | |
|---|---|---|---|---|
| 4,751,528 | * | 6/1988 | Spehrley, Jr. et al. | 346/140 |
| 4,914,562 | | 4/1990 | Abe et al. | 346/140 R |
| 4,952,950 | | 8/1990 | Bibl | 346/157 |
| 5,031,002 | * | 7/1991 | Yaguchi | 355/312 |
| 5,287,123 | | 2/1994 | Medin | 346/140 R |
| 5,296,873 | | 3/1994 | Russell | 346/25 |
| 5,371,531 | | 12/1994 | Rezanka | 347/43 |
| 5,406,321 | | 4/1995 | Schwiebert | 347/102 |
| 5,479,199 | | 12/1995 | Moore | 347/102 |
| 5,495,275 | * | 2/1996 | Martinengo | 347/112 |
| 5,500,667 | | 3/1996 | Schwiebert | 347/102 |
| 5,510,822 | | 4/1996 | Vincent et al. | 347/102 |
| 5,603,493 | | 2/1997 | Kelly | 271/188 |
| 5,668,584 | | 9/1997 | Broder | 347/102 |
| 5,717,446 | * | 2/1998 | Teumer et al. | 347/35 |
| 5,742,315 | | 4/1998 | Szlucha | 347/102 |
| 5,771,054 | | 6/1998 | Dudek | 347/102 |
| 5,774,155 | | 6/1998 | Medin | 347/102 |
| 5,896,154 | | 4/1999 | Mitani et al. | 347/102 |
| 6,168,269 | * | 1/2001 | Rasmussen et al. | 347/102 |

FOREIGN PATENT DOCUMENTS

| | | |
|---|---|---|
| 2226528 | 7/1990 | (GB) . |
| 2314043 | 12/1997 | (GB) . |

OTHER PUBLICATIONS

European Search Report, Apr. 9, 2001.

The Examiner's attention is directed to commonly owned US Patent Applications Nos. 09/163,287; 09/163,275; 09/163,098, and 09/163,274—all filed Sep. 29, 1998.

The Examiner's attention is also directed to commonly owned US Patent Application No. 09/412,842 filed Oct. 5, 1999.

Hall et al., Inkjet Printer Print Quality Enhancement Techniques, Feb. 1994 Hewlett Packard Journal, pp. 35–40.

* cited by examiner

*Primary Examiner*—John S. Hilten
*Assistant Examiner*—Minh H. Chau

(57) ABSTRACT

An approach for managing the thermal stresses introduced into a heated belt of the type used for transporting media through an ink-jet printer so that the portion of the belt that transports the print media through the print zone does not buckle. The temperature of the belt is controlled to ensure that any temperature gradient produced in the belt is not great enough to buckle the belt in the print zone. Put another way, the temperature profile in the belt is substantially flat. As another approach to the present invention, the belt is bent in the print zone to create a force component in the belt for resisting thermal stress and to increase the belt area moment to greatly enhance resistance to buckling of the belt.

12 Claims, 4 Drawing Sheets

BUCKLING CONTROL FOR A HEATED BELT-TYPE MEDIA SUPPORT OF A PRINTER

TECHNICAL FIELD

This invention relates to mechanisms for controlling buckling in a heated, belt-type system for advancing print media through a printer.

BACKGROUND AND SUMMARY OF THE INVENTION

An ink-jet printer includes at least one print cartridge that contains ink within a reservoir. The reservoir is connected to a print head that is mounted to the body of the cartridge. The print head is controlled for ejecting minute droplets of ink from the print head to a sheet of print medium, such as paper, that is advanced through the printer.

Many ink-jet printers include a carriage for holding the print cartridge. The carriage is scanned across the width of the paper, and the ejection of the droplets onto the paper is controlled to form a swath of an image with each scan. Between carriage scans, the paper is advanced so that the next swath of the image may be printed. Sometimes, more than one swath is printed before the paper is advanced. In some printers, a stationary print head or array of print heads may be provided to extend across the entire width of the paper that moves through the printer.

The relative position of the print head(s) and paper must be precisely maintained to effect high-resolution, high-quality printing. This precision is especially important in the region known as the "print zone" of the printer, which is the space where the ink travels from the print head to the paper. Changes in the relative position of the print head and paper will cause the expelled ink droplets to land imprecisely on the paper and thus degrade the quality of the printed image.

One method of securing a sheet of paper for movement through a printer is to direct the paper against one side of a perforated belt. Vacuum pressure is applied to the other side of the belt and, thus, through the belt perforations to secure the paper to the belt. The belt, with secured paper, is moved relative to the print head and through the print zone where ink is printed on the paper.

The belt may be configured as an endless loop and secured between a pair of rollers that are mounted to the printer to drive the belt under tension. The upper surface of the belt transports the paper that is guided onto the belt. The porous belt moves over a support surface that includes vacuum ports through which the vacuum pressure is applied to the belt and to the paper that is carried by the belt.

The speed with which the print media is moved through a printer is an important design consideration, called "throughput." Throughput is usually measured in the number of sheets of imaged print media moved through the printer each minute. A high throughput is desirable. A printer designer, however, may not merely increase throughput without considering the affect of the increase on other print quality factors.

For instance, one important factor affecting the print quality of ink-jet or other liquid-ink printers is drying time. The print media movement must be controlled to ensure that the liquid ink dries properly once printed. If, for example, sheets of printed media are allowed to contact one another before ink is adequately dried, smearing can occur as a result of that contact. Thus, the throughput of a printer may be limited to avoid contact until the sheets are sufficiently dry.

This potential for smearing is present irrespective of whether ink is applied by a scanning technique or by other methods, such as stationary print head arrangements that effectively cover an entire width of the print media.

In addition to throughput, an ink-jet printer designer must be concerned with the problem of cockle. Cockle is the term used to designate the uncontrolled, localized warping of absorbent print media (such as paper) that occurs as the liquid ink saturates the fibers of the paper, causing the fibers to swell. The uncontrolled warping causes the paper to move relative to the print head, changing both the distance and angle between the print head and the paper. These unpredictable variations in distance and angle reduce print quality.

Heat may be applied to the print media in order to speed the drying time of the ink. If heat is applied to the media, it is useful to have it applied so that the media is heated as it is moved through the print zone during a printing operation. The heat rapidly drives off (evaporates) a good portion of the liquid component of the ink so that cockle is unable to form, or at least is minimized.

An effective way to heat the print media is by conduction, in a manner that will not overheat the print head nor interfere with the trajectory of the droplets expelled from the print head. This can be accomplished by heating the underside of the belt by conduction, which heat is thus transferred to the media carried by the belt.

If the part of the belt in the vicinity of the print media is unevenly heated, undesirable ripples may be produced in the belt. More particularly, rippling or buckling in the belt happens when a heated portion of the belt expands against the adjacent, relatively cooler portion of the belt. If the temperature difference or gradient is large enough, the cooler portion constrains the expansion of the belt in the plane of the belt. As a result, thermal stress is introduced into the belt, and the belt responds by buckling away from the belt support surface.

The occurrence of such belt buckling or rippling in the print zone is undesirable because the portion of the print media that overlays the ripple will be lifted slightly by the ripple toward the print head. As noted, such uncontrolled changes in the distance between the media and the print head can reduce print quality. Moreover, conductive heat transfer is substantially reduced or lost in the region where the belt moves away from the heated support surface. The uneven heating of the media resulting from such heat loss leads to additional print defects.

The present invention is generally directed to techniques for managing the thermal stresses introduced into a heated belt of the type just described so that the portion of the belt that transports the print media through the print zone remains free of ripples.

In one approach to the invention, the temperature of the belt is controlled to ensure that the temperature gradient of the belt remains below a predetermined threshold in the vicinity of the print zone so that the induced thermal stresses remain below a level that would create buckling.

As another approach to the present invention, the belt is bent in the print zone to create a greater (i.e., stiffer) area moment in the belt for countering the thermal stress that would otherwise produce buckling of the belt.

Both apparatuses and methods for carrying out the invention are described. Other advantages and features of the present invention will become clear upon review of the following portions of this specification and the drawings.

DETAILED DESCRIPTION OF PREFERRED EMBODIMENTS

Figure 1:
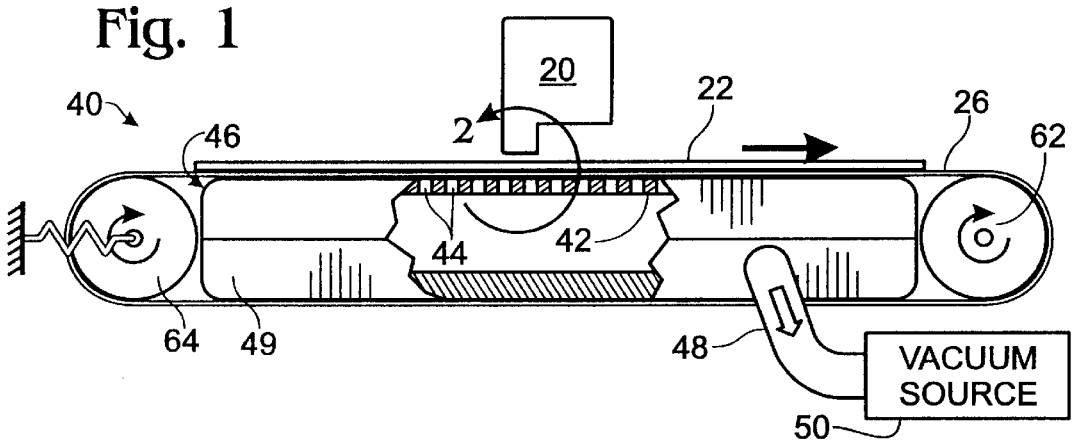
FIG. 1 is a diagram showing the primary components of one embodiment of an ink-jet printer that includes a heated, belt-type media support system to which the present invention is adaptable.

The diagram of FIG. 1 shows an ink-jet print cartridge 20, which may be mounted to a printer by conventional means such as a movable carriage assembly (not shown). For illustrative purposes, only one cartridge is shown in the figures, although it is contemplated that more than one cartridge may be employed. For instance, some color printers use four cartridges at a time, each cartridge carrying a particular color of ink, such as black, cyan, yellow, and magenta. In the present description, the term "cartridge" is intended to mean any such device for storing liquid ink and for printing droplets of the ink to media. Preferred cartridges are available from Hewlett Packard Co. of Palo Alto, Calif. http://www.hp.com. The cartridges may be connected to remote sources of ink that supplement the ink supply that is stored in each cartridge.

The carriage assembly supports the cartridge 20 above print media, such as a sheet of paper 22. A print head 24 (FIG. 2) is attached to the underside of the cartridge. The print head 24 is a planar member and has an array of nozzles through which the ink droplets are ejected. The cartridge 20 is supported so that the print head is precisely maintained at a desired spacing from the paper 22, such as, for example, between 0.5 mm to 1.5 mm from the paper. The paper 22 is advanced though the printer, and the cartridge print head 24 is controlled to expel ink droplets onto the paper.

Figure 2:
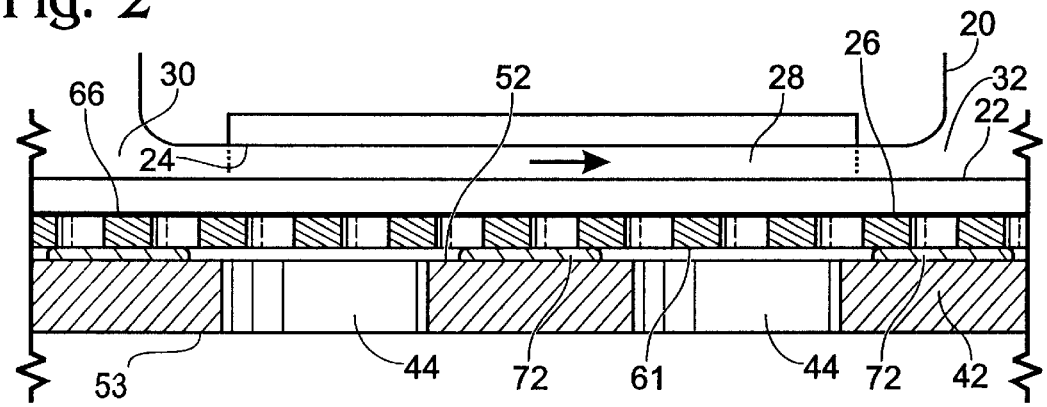
FIG. 2 is an enlarged detail view of a portion of the embodiment depicted in FIG. 1.

In the vicinity of the cartridge 20, the paper 22 is supported on a moving conveyor belt 26. The belt 26 moves the paper 22 through the printer's print zone 28 (FIG. 2). As noted above, the print zone 28 is the space in the printer where the ink is moved from the print head 24 to the paper 22. Two imaginary boundaries of the print zone 28 are shown in dashed lines in FIG. 2.

For the purposes of this description, one can consider the space that is adjacent to the print zone 28 (to the left in FIG. 1) as an entry zone 30 through which the paper 22 is conveyed before entering the print zone 28. The space that is on the opposite side of the print zone is the exit zone 32, through which the paper is conveyed as it passes out of the print zone 28 on its way to a collection tray or the like.

The paper 22 is heated as it is moved through the printer. Heat is applied to the paper in conjunction with mechanisms for applying vacuum pressure to the paper (or any other media) to support the paper on the belt as it moves through the printer.

Preferably, the heat is applied to the paper 22 while the paper is in the print zone 28. Also provided are mechanisms for heating the paper as it moves through the entry zone 28 and the exit zone 32.

Figure 3:
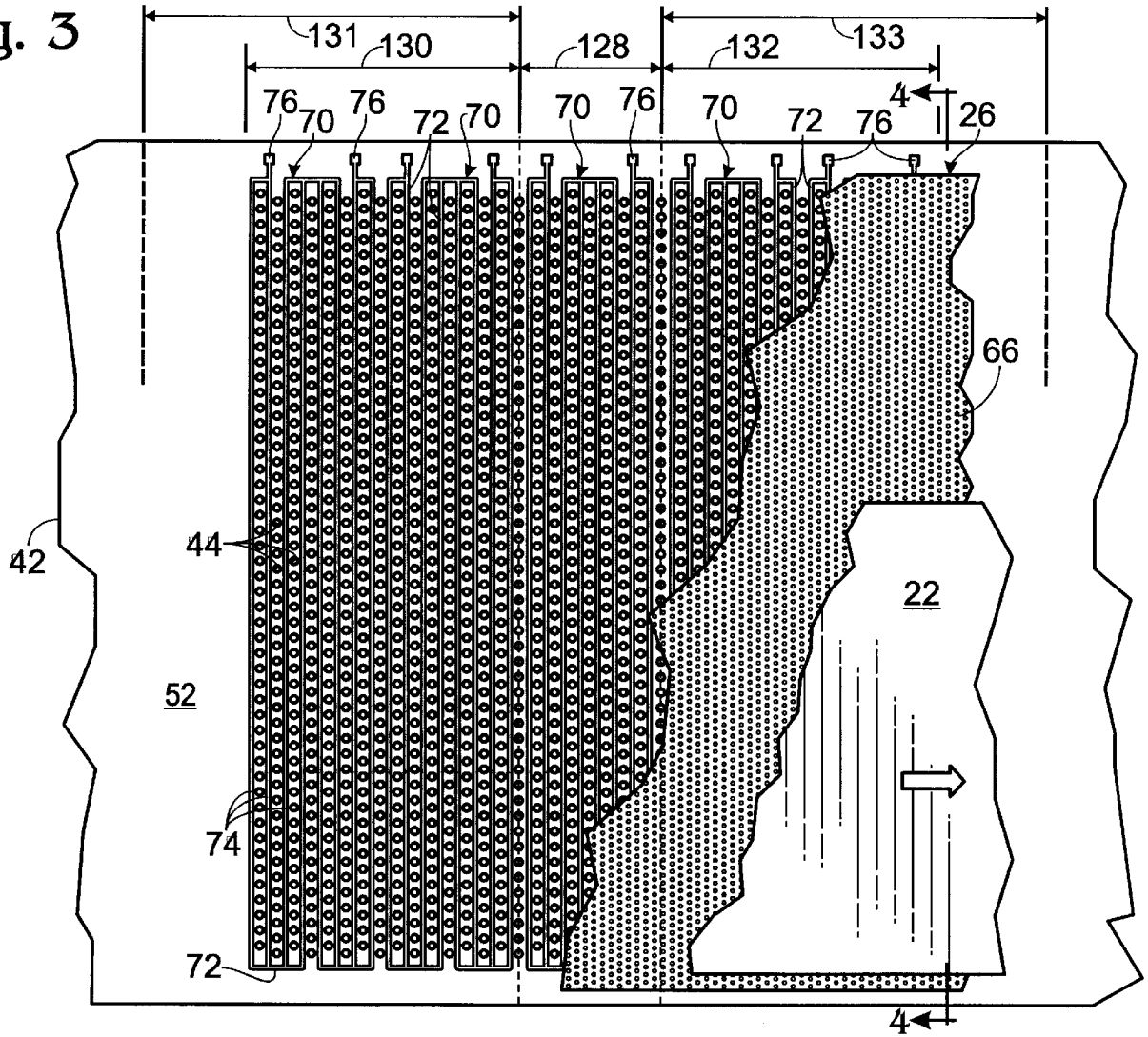
FIG. 3 is a top plan view of mechanisms for supporting and heating the print media in the printer.

With reference to FIGS. 1–3, the particulars of a media-handling system 40 for heating and transporting the media through the printer are now described. The system 40 includes a platen 42 that generally provides support for the belt 26 that, in turn, carries media such as paper sheets 22 through the print zone of the printer.

The platen 42 is a rigid member, formed of heat conductive material such as stainless steel or an aluminum alloy. The platen may also be formed of copper or another metal having a copper-coated outer surface. Preferably, the surface of the platen over which the belt 26 moves has high thermal conductivity for reasons described more below.

It is also contemplated that the platen 42 may be formed of material having low thermal conductivity. This would enable a somewhat more responsive control of heat applied to the media directly from the heaters that are described more fully below.

The belt 26 is porous, and vacuum pressure is employed for drawing the paper 22 against the belt and platen to support the paper as it is advanced through the printer. Thus, the platen 42 has ports 44 formed through it. The platen 42 also forms the top of a vacuum chamber or box 46 (FIG. 1) that is inside the printer.

The vacuum box 46 includes a body 49 to which the platen 42 is attached. The box 46 is thus enclosed except for the ports 44 in the platen 42 and a conduit 48 to a vacuum source 50. The vacuum source is controlled to reduce the pressure in the interior of the box 46 so that suction or vacuum pressure is generated at the ports 44.

The platen 42 has a planar support surface 52 (FIG. 2) that faces the print head 24. The ports 44 in the platen open to the support surface 52. As best shown in FIG. 3, the ports are preferably formed in uniform rows across the support surface. The ports 44 are sized and arranged to ensure that vacuum pressure is uniformly distributed over the platen surface 52. In a preferred embodiment, the ports are circular where they open to the surface 52. The circles are 3.0 mm in diameter and have centers spaced apart by 6.0 mm to 6.25 mm. Alternatively, the ports could be sized to provide a nonuniform vacuum pressure over the platen surface. For instance, the vacuum pressure could be relatively lower in the areas away from the print zone.

The belt 26 is configured as an endless loop between a fixed drive roller 62 and tension roller 64 (FIG. 1). In the figures, the belt 26 is shown rotating clockwise, with a transport portion 66 of the belt (FIG. 2) sliding over the support surface 52 of the platen 42. The return portion of the belt 26 underlies the vacuum box 46. Paper 22 is directed onto the transport portion by conventional pick and feed roller mechanisms (not shown).

The porous belt 26 permits a uniform communication of vacuum pressure to the underside of the paper 22. The belt 26 also conducts heat to the paper 22 (or other type of print media) that is carried on its transport portion 66. To this end, the belt is made of heat conductive material.

In a preferred embodiment the belt is formed of a stainless steel alloy, commonly known as Invar 36, having a thickness of about 0.125 mm. (It will be appreciated that because the belt is so thin in this embodiment there is little material through which heat transfer is required. Thus, the thermal conductivity of the belt material is not a critical factor.) The belt 26 has a width that is sufficient to cover all but the margins of the platen 42 (FIG. 3). The belt 26 is heated by conduction. In a preferred embodiment, the conductive heating of the belt is accomplished by the use of heaters 70 that are attached to the support surface 52 of the platen 42 as best shown in FIG. 3.

The heaters 70 are comprised of an array of linear, resistive heating elements 72. The heating elements 72 extend between the rows of vacuum ports 44 that are defined on the support surface 52 of the platen. At the edges of the support surface 52 the individual elements 72 are joined (as at reference numeral 74) and the termini of the heaters are enlarged into two contact pads 76 for connecting to a current source and ground as explained more below.

The heaters 70 are preferably arranged so that one heater, a "print region heater," resides on the central portion of the platen 42 immediately underlying the print zone 28. As shown in FIG. 3, the region on the platen support surface underlying the print zone is designated with the reference number 128 and is hereafter referred to as the print region 128 of the platen.

In the embodiment depicted in FIG. 3, there are also heaters 70 in the entry region 130 of the platen surface (that region corresponding to the above-described entry zone 30). These heaters will be referred to as the entry region heaters. Similarly, "exit region heaters" are provided in the exit region 132 of the platen surface (the region corresponding to the above-described exit zone 32).

The heaters 70 are of the thick-film type. The heaters include a ceramic base layer that is silk-screened onto the support surface 52 of the platen in the pattern depicted in FIG. 3. Resistive paste layers are then deposited between vitreous dielectric layers, which are dried and fired to produce an integrated heating element 72. The heating elements 72 are about 1.5 mm wide (as measured left to right in FIG. 2) and protrude slightly above the support surface 52 as shown (although exaggerated) in FIG. 2. In a preferred embodiment, the heating elements 72 protrude by about 0.05 to 0.10 mm above the support surface 52 of the platen 42.

The underside 61 of the transport belt 26 (FIG. 2) slides over the top surfaces of the heating elements 72 as the belt is driven to move paper 22 through the print zone. Preferably, the underside of the belt and/or the support surface 52 of the platen is thinly coated with a layer of low-friction material, such as Dupont's polytetrafluoroethylene, sold under the trademark Teflon.

It is noteworthy that as an alternative arrangement the heaters 70 can be mounted to an interior or bottom surface 53 (FIG. 2) of the support surface so that the heat is conducted through the platen to the belt that slides directly over the support surface.

Figure 4:
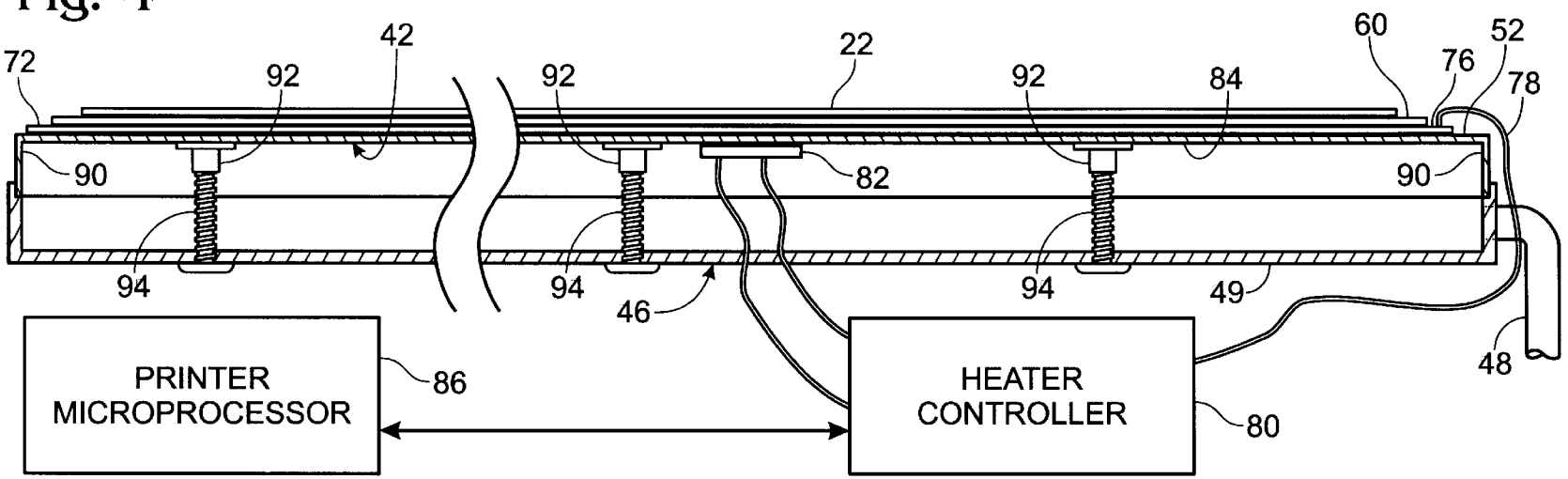
FIG. 4 is a section view taken along line 4—4 of FIG. 3.

As depicted in FIG. 4, the contact pads 76 of each heater 70 are connected, as by leads 78, to a heater controller 80. In a preferred embodiment, the heater controller 80 is connected to at least three temperature sensors 82 (only one of which appears in FIG. 4). One sensor is attached to the undersurface 84 of the platen, centered in the print region 128 and between a row of ports. The other two sensors are located to underlie, respectively, the entry region 130 of the platen surface and the exit region 132 of the platen surface. The sensors 82, which can be embodied as thermistors, provide to the heater controller 80 an output signal that is indicative of the temperature of the platen 42.

The heater controller 80 is also provided with control signals from the printer microprocessor 86. (For illustrative purposes, the heater controller is shown as a discrete component, although such heater control may be incorporated into the overall printer control system.) Such signals may provide, for example, an indication of the type of media about to be printed.

In accordance with the present invention, the heater controller 80 drives the heaters 70 as needed to ensure that the temperature profile of the belt 26 is such that no significant temperature gradient is generated in the belt in the vicinity of the print zone, which gradient could lead to the thermal stress and buckling described above. This aspect of the heater controller 80 is best understood with reference to the graph of FIG. 5.

Figure 5:
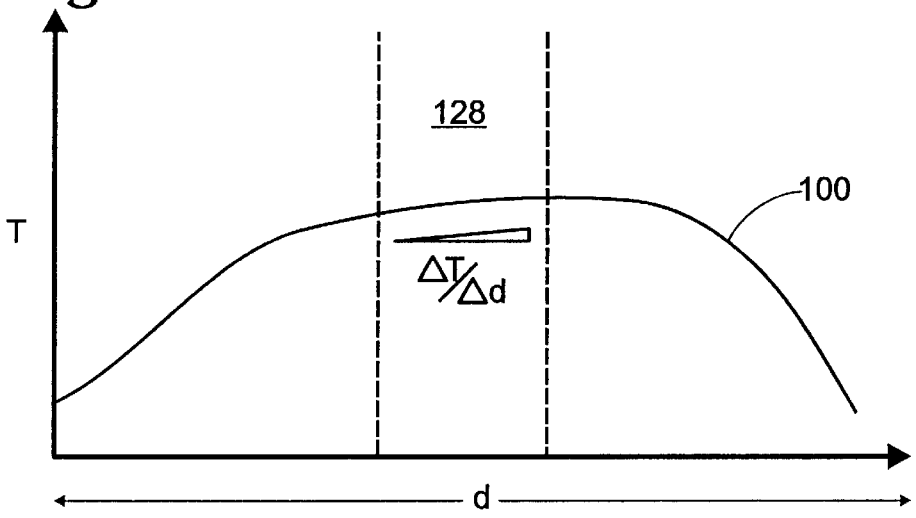
FIG. 5 is a graph depicting a temperature profile of a heated belt as controlled by one aspect of the present invention.

FIG. 5 illustrates a preferred temperature profile of the belt as it is operated to move paper 22 through the printer. The ordinate "T" of the graph is the temperature of the belt in units such as degrees Celsius. The abscissa "d" of the graph represents, in units of length, the transport portion 66 of the belt over the support surface 52 of the platen 42. The temperature profile of the belt, indicated by line 100 in the graph, is managed so that in the vicinity of the print region 128 (indicated as the dashed lines in FIG. 5) the temperature of the belt is maintained at substantially uniform level. Preferably the temperature of the belt is controlled so that any change that occurs in the print region 128 (hence, print zone 28) will be less than about 50° C. throughout the print zone.

It will be appreciated that the temperature gradient that a belt can withstand without buckling will vary depending upon the belt thickness, vacuum pressure applied, etc. Thus, one of ordinary skill will understand that a temperature variation of greater than 50° C. may be acceptable (that is, no buckling occurs) where the belt and/or vacuum pressure employed effect more resistance to buckling than those described with respect to the preferred embodiment.

Put another way, the slope of the temperature profile 100, which can be characterized as the temperature gradient in the belt, is represented in FIG. 5 as the change in temperature over distance, or $\Delta T/\Delta d$ as shown in the graph. A positive temperature gradient means that this value $\Delta T/\Delta d$ is positive at a given point in the temperature profile, and that the temperature of the belt is increasing at that point. In accordance with the present invention the belt temperature of the preferred embodiment is controlled so that the temperature gradient associated with the belt in the vicinity of the print zone is very near zero, or no greater than that which would cause buckling for a particular embodiment.

FIG. 5 shows the slope of the temperature profile as having a very slight temperature gradient in the print region 128. It will be appreciated that, for some systems (for example, where belts having lower thermal conductivity) a small temperature gradient will be acceptable because ripples will not be produced in the belt. It is best, however, to strive for the above-stated goal of having a uniform temperature profile through the print region 128. An abrupt change in the temperature profile is to be avoided in the print region 128.

In view of the foregoing, it will be appreciated that no buckling or rippling of the belt 26 (attributable to thermal stress) will occur in the print zone because the temperature profile of the belt throughout the print zone 28 is controlled to be substantially flat. As noted above, this temperature control is established in the vicinity of the print zone, which vicinity may include, in addition to the print region 128 of the platen, the entry region 130 and exit region 132 and regions adjacent to those. To this end, the entry and exit regions are heated (hence, the corresponding parts of the belt 26 are heated) to the extent necessary to match the temperature of the belt in the print zone. This is done to prevent buckling that might occur outside of the print zone but that affects (changes) the position of the paper inside of the print zone. In this regard, the distance beyond the print region 128 through which a substantially flat temperature profile should be maintained is a function of several factors, including the media stiffness and thermal characteristics, as well as the thermal characteristics of the belt 26.

For instance, in the course of printing relatively stiff paper, it may be necessary to ensure that the flat belt-temperature profile extends well beyond the distance corresponding to the entry region 130 of the platen. This is because a belt ripple outside of this region 130 may, with stiff paper, undesirably change the position of the stiff paper in the print zone and reduce print quality, as discussed above. This extended distance (that is, the distance requiring in the belt the establishment of a substantially flat temperature profile) is shown as 131 in FIG. 3. A similar extended distance 133 is shown on the exit side of the print zone.

These extended portions 131, 133 of the platen adjacent to the entry region 130 and exit region 132 may or may not include the same arrangements and/or sizes of vacuum ports (and associated fluid communication with the interior of the box 46) for securing the media, depending primarily upon the physical characteristics of the media that is accommodated by the printer. Preferably, however, these portions of the platen 42 have high thermal conductivity (greater than 150 W/mK) so that heat generated by the heaters in the entry region 130 and exit region 132 will be efficiently transferred through the extended portions 131, 133 to ensure the belt 26 has a flat temperature profile in the vicinity of the print zone. It is noted that the platen thickness can be decreased so that material having a lower thermal conductivity than that just specified may be used.

It is also contemplated that the entire upper surface of the platen 42 may be sized to define the support surface that underlies the transport portion 66 of the belt 26. Also, the extended distances 131 and 133 could be directly heated by heaters that, in conjunction with heaters in the entry, print and exit regions, would underlie the entire transport portion of the belt.

It is also contemplated that in some instances the desired, substantially flat temperature profile of the belt may be best maintained without the use of heaters 70 in the print region 128. Heat transfer from the adjacent heaters in the entry region 130 and, if necessary, from the exit region, may be adequate for maintaining the profile. The temperature of the belt in the print zone, therefore, would not be otherwise heated by heaters in the print zone.

The heater controller 80 identifies the corresponding range of temperatures that should be read on the sensors 82 to ensure that the correct amount of heat is applied to the belt 26 in the region corresponding to the particular sensors for maintaining the desired temperature profile. The corresponding heaters 70 are then driven with the appropriate current for achieving the correct sensor temperature. In one preferred embodiment, the heater in the print region 128 is normally driven by current sufficient to establish a temperature of about 110° C. through the print zone.

The identification of the desired temperature profile can be carried out, for example, by resort to a look-up table stored in read only memory (ROM) of the heater controller 80 and that is made up of an empirically derived set of temperature profiles correlated to many different media types. For instance, if the printer operator selects a transparency-type of print media, the maximum temperature of the corresponding temperature profile of the belt 26 to be detected on sensors 82 (which temperature is transferred to the media) would likely be lower than such temperature for paper media.

Irrespective of the relative size of the heated entry, print, and exit regions, it is desirable to control those heaters separately from one another. To this end, separate control leads are provided from the heater controller 80 to the contact pads 76 of the heaters 70 located in each surface region. The separate control of the heating regions affords a degree of customization for heating the print media, depending, for example, on the physical characteristics of the media used and for maintaining the sought-after temperature profile discussed above.

FIG. 4 depicts one method for assembling a vacuum box 46 using a platen 42 as described above. Preferably the portion of the platen 42 that defines the entry region 130, print region 128, and exit region 132 is a separate module that is fastened to the body 49 of the vacuum box. This module also defines the support surface 52 and is about 1.0 mm thick. At the edge of the module, there are integrally attached flanges 90 that extend downwardly, perpendicular to the surface 52. The flanges are joined at each corner of the module and provide stiffening support to the plate surface to ensure that the surface does not bend out of its plane. This helps to ensure that the distance between the print head 24 and paper 22 that is carried by the support surface remains constant even as the platen is heated and cooled.

The lowermost edges of the flanges 90 seat in correspondingly shaped grooves formed in the vacuum box body 49. A gasket is provided to seal this junction. The undersurface 84 of the platen 42 also includes a number of evenly spaced, internally threaded studs 92. Three studs appear in FIG. 4. The studs receive the threaded shafts of fasteners 94 that pass through the vacuum box body 49 to thus fasten together the platen 42 and the body 49.

Figure 6:
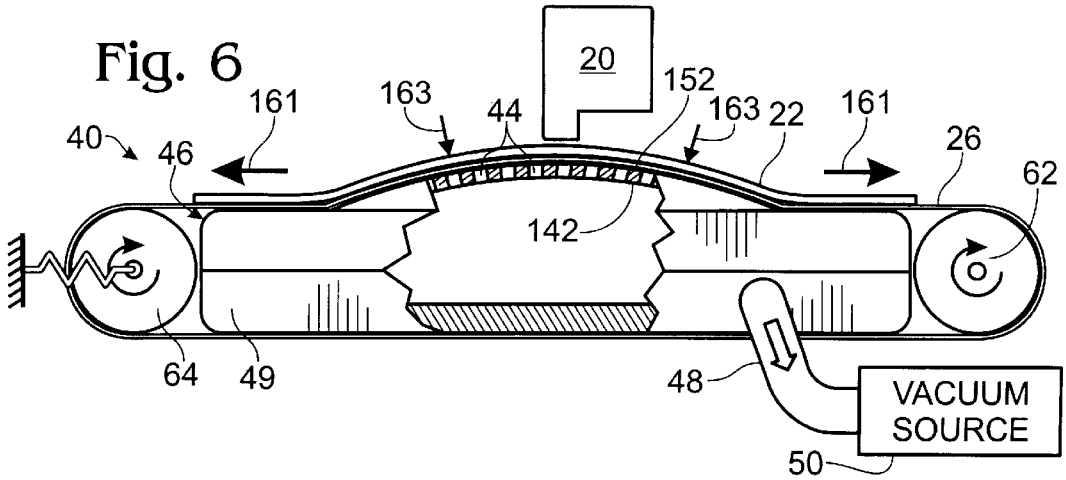
FIG. 6 is a diagram showing the primary components of another embodiment of an ink-jet printer that includes a heated, belt-type media support system incorporating another aspect of the present invention.

FIG. 6 is a diagram showing another embodiment of an ink-jet printer that includes a heated, belt-type media support system to which the present invention is adaptable. In this embodiment, components matching those in the embodiment of FIG. 2 are identified with the same reference numbers.

Before proceeding with this description it is pointed out that buckling that may occur as a result of the thermal stress directed generally parallel to the direction of belt travel will be countered by the tension present in the belt that is attributable to the tension applied by the drive system, such as tension roller 64. The belt tension, however is unable to counter thermal stresses (and attendant buckling) directed generally perpendicular to the direction of belt travel (i.e., perpendicular to the plane of FIG. 6, for example). The next-described aspect of the invention provides a mechanism for countering such laterally directed stress (as does the thermal approach described above).

Generally, the belt 26 is bent to create a larger area moment of inertia in the belt for countering laterally directed thermal stress in the belt that might otherwise produce buckling of the belt (FIG. 6). Also, more strain energy is required to lift or deflect the belt off a curved surface as compared to a flat surface.

Preferably, the bending of the belt 26 in this aspect of the invention is accomplished by configuring the platen 142 (FIG. 6) so that its support surface 152 defines a convex curve (shown exaggerated in FIG. 6) across substantially all of the heated part of the platen 142. In this embodiment, the curvature within the print zone is uniform, having a radius of between about 30 to 50 centimeters, depending upon the width of the print zone (a longer radius is employed with cartridges that have printheads that provide relatively wider print zones).

As a result of the bending imparted into the belt 162 by the curvature of the support surface 152 the area moment of the belt is increased as compared to a planar orientation of the belt (as viewed from the side as in FIG. 6) This, in turn, increases the belt's resistance to buckling in the belt by countering the lateral thermal stress that might reside in the belt in the event that the belt carries a temperature gradient as discussed above.

It will be appreciated by one of ordinary skill in the art that the normal component of the tension in the belt couples with the vacuum pressure for holding the belt against the curved platen to further resist thermal stresses that might otherwise induce buckling in the belt. As such, one will also appreciate that higher or lower vacuum pressure levels will respectively decrease and increase the amount of curvature required (hence the amount of normal tension component) in a platen made in accordance with the present embodiment.

In the event that other print quality considerations mandate a flat platen surface in the print zone, an alternative embodiment to that just described with respect to FIG. 6 can be provided whereby the platen is made flat through the print zone. Away from the print zone, the platen is curved as explained above. In the event the entire support surface of the platen is not heated in this or any other bent-belt embodiment, the curvature should extend through at least the junction of the heated and non-heated portions of the platen so that the above described resistance to lateral buckling is present at the location where the greatest temperature gradients are likely to occur.

Figure 7:
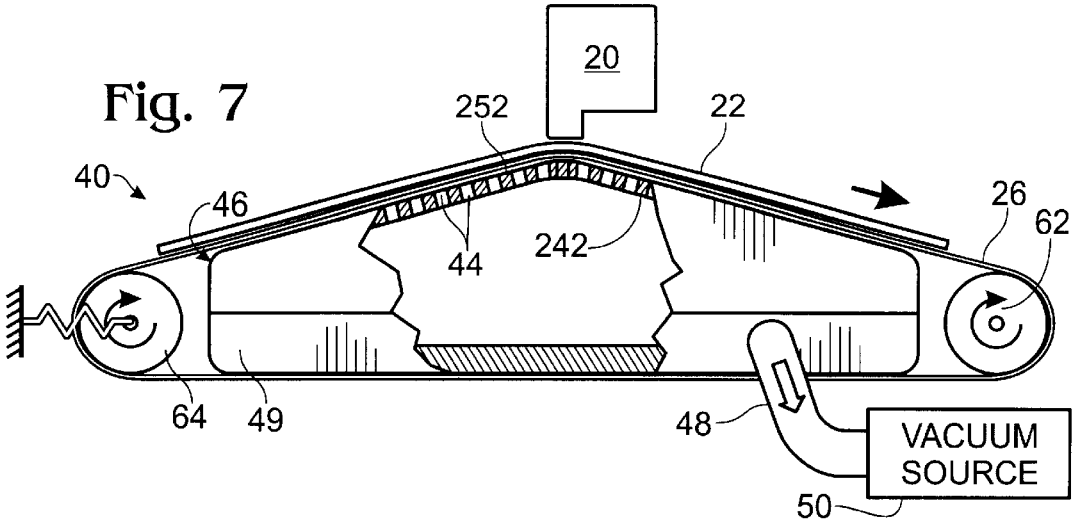
FIG. 7 is a diagram showing the primary components of another embodiment of an ink-jet printer incorporating yet another aspect of the present invention.

FIG. 7 depicts an embodiment like FIG. 6 but where the greatest amount of curvature of the platen support surface 252 is confined to a part of the surface very near the print zone. This curvature may have a radius of about 30 to 50 centimeters, depending upon the width of the print zone (as mentioned above). The portions of the surface 252 adjacent to curved portion of the surface and out of the print zone can be flat or have a larger-radius curve. This configuration provides at the print zone a relatively high area moment for correspondingly greater resistance to buckling as compared to a larger-radius curve through the print zone.

It is noteworthy the earlier described techniques for establishing a uniform belt temperature gradient profile in the belt can be combined with the bending approaches just discussed to ensure no buckling occurs in the belt.

Although preferred and alternative embodiments of the present invention have been described, it will be appreciated by one of ordinary skill that the spirit and scope of the invention is not limited to those embodiments, but extend to the various modifications and equivalents as defined in the appended claims.

What is claimed is:

1. A method of transporting a sheet of print media that is advanced through a printer that has a print zone in which ink is applied to the media, the method comprising the steps of:

moving a belt through the print zone;

orienting the belt to have a transport portion for carrying print media through the print zone; and controlling the temperature of the transport portion of the belt in the print zone to be substantially uniform.

2. The method of claim 1 wherein the controlling step includes heating the belt at a location outside of the print zone.

3. The method of claim 1 wherein the controlling step includes heating the belt in a manner to prevent a change in the transport portion temperature from exceeding that which would induce buckling of the belt in the print zone.

4. The method of claim 1 wherein the controlling step includes changing the temperature of the transport portion outside of the print zone without changing the temperature of the transport portion in the print zone.

5. The method of claim 1 including the step of bending the transport portion of the belt in the vicinity of the print zone.

6. The method of claim 1 including the steps of:

supporting the transport portion of the belt on a support surface;

providing heaters for heating the support surface in the print zone; and transferring heat from the heaters away from the print zone thereby to heat the transport portion of the belt outside of the print zone.

7. The method of claim 1 including the steps of:

supporting the transport portion of the belt on a support surface;

providing heaters for heating the support surface outside of the print zone; and transferring heat from the heaters into the print zone thereby to heat the transport portion of the belt in the print zone without otherwise heating the transport portion of the belt in the print zone.

8. A method of supporting a sheet of print media that is advanced through a printer that has a print zone in which ink is applied to the media, the method comprising the steps of:

moving a belt across a surface of a platen;

drawing a sheet of print media against the belt as the belt moves across the platen and through the print zone of the printer;

heating the belt controlling the temperature in the belt to maintain a substantially uniform temperature in the belt in the vicinity of the print zone; and bending the belt in the print zone.

9. The method of claim 8 wherein the moving step includes supporting the belt so that the belt is wrapped around a pair of rollers and the bending step includes bending the belt in a heated portion of the belt that is between the two rollers.

10. The method of claim 9 including the step of keeping the belt flat through the print zone.

11. The method of claim 8 wherein the bending step includes providing the platen with a curved surface over which the belt is drawn.

12. The method of claim 8 wherein the bending step includes bending the belt along a radius of 50 centimeters or less.

* * * * *